US008902074B2

(12) United States Patent
Landry et al.

(10) Patent No.: US 8,902,074 B2
(45) Date of Patent: Dec. 2, 2014

(54) HARNESS FOR FALL PROTECTION

(75) Inventors: Michel Landry, Mascouche (CA); Bechir Jazi, Montreal (CA); Alex Tsen, Toronto (CA)

(73) Assignee: Honeywell International, Inc., Morristown, NJ (US)

( * ) Notice: Subject to any disclaimer, the term of this patent is extended or adjusted under 35 U.S.C. 154(b) by 645 days.

(21) Appl. No.: 12/868,987

(22) Filed: Aug. 26, 2010

(65) Prior Publication Data

US 2012/0050036 A1 Mar. 1, 2012

(51) Int. Cl.

| | |
|---|---|
| ***G08B 21/00*** | (2006.01) |
| ***A62B 35/00*** | (2006.01) |
| ***G08B 25/01*** | (2006.01) |

(52) U.S. Cl.

CPC ..... *G08B 25/016* (2013.01); *A62B 35/0018* (2013.01)

USPC ..... 340/665; 340/540; 340/457.1; 340/668; 182/3; 280/801.1; 280/808; 244/151 R

(58) Field of Classification Search

CPC ..... B60R 22/12; B60R 22/48; A62B 35/00; A62B 35/0025; D07B 1/145

USPC ..... 340/540, 457.1, 665, 668; 182/3; 280/801.1, 808; 244/151 R

See application file for complete search history.

(56) References Cited

U.S. PATENT DOCUMENTS

| | | | | |
|---|---|---|---|---|
| 3,912,939 | A * | 10/1975 | Quantz et al. | 340/573.1 |
| 5,605,035 | A * | 2/1997 | Pethrick et al. | 57/200 |
| 5,697,329 | A * | 12/1997 | Bell et al. | 119/857 |
| 6,211,793 | B1 * | 4/2001 | Smithson | 340/665 |
| 6,289,742 | B1 * | 9/2001 | De Angelis | 73/835 |
| 6,572,148 | B2 * | 6/2003 | Wittenberg | 280/808 |
| 7,005,976 | B2 * | 2/2006 | Hagenbuch | 340/457.1 |
| 2004/0119599 | A1 * | 6/2004 | Stevenson et al. | 340/686.1 |
| 2007/0182534 | A1 * | 8/2007 | Gregory | 340/457.1 |

* cited by examiner

*Primary Examiner* — Andrew Bee

(74) *Attorney, Agent, or Firm* — Craige Thompson; Thompson Patent Law

(57) ABSTRACT

A safety harness includes at least one of integrally formed electrical conductors or optical conductors. The conductors can be energized by a replaceable electrical supply. An electrical or an optical sensor can couple an associated signal to sensing circuitry. The sensing circuitry responds to variations in the signal as the condition of the harness changes. A fault indicating output device, such as an audible or visual indicating device, carried on the harness can alert a user to a potential harness failure. Harness condition can be transmitted wirelessly to a displaced monitoring site.

28 Claims, 5 Drawing Sheets

EXAMPLES OF DIFFERENT KNITTING STRUCTURES
CONDUCTIVE FIBERS INCLUDED

TYPE 3: WEAVED WEBBING

TYPE 2: WEAVED WEBBING

TYPE 1: WEAVED WEBBING

EXAMPLES OF DIFFERENT CONDUCTIVE FIBERS STRUCTURES

VERY SENSITIVE WEBBING ON EDGES; TOP, BOTTOM, LEFT, RIGHT NOT SENSITIVE ON CENTER

NOT SENSITIVE WEBBING ON TOP, & BOTTOM, SENSITIVE ON CENTER, LEFT & RIGHT

VERY SENSITIVE WEBBING ON LEFT & RIGHT NOT SENSITIVE ON TOP, BOTTOM & CENTER

HARNESS FOR FALL PROTECTION

FIELD

The invention pertains to safety harnesses. More particularly, the invention pertains to harnesses which automatically provide condition indicia to a user of the harness.

BACKGROUND

Safety Harnesses are used in extreme conditions and environments on a regular basis. Examples include construction sites, building structures, wind mills, petrochemical refineries, sandblasting environments, shipyards, etc. The material used for the harnesses could degrade with normal use in a long period of time or short period of time. This is not linear verses the life cycle. Such damage could include impact damage, ultra violet degradation, corrosion, moisture, cuts & holes, tearing, stitching damages and the like all without limitation.

Sometimes the damage is just not apparent to the user. At other times, the damage seems minor at the first look. However, all defects can have a big impact on the performance of the product when it is time to perform and potentially save lives, especially for fall protection products.

There are some known "fault indicators" for safety harnesses. Known harnesses do not provide indicators of UV degradation, corrosion, moisture, cuts & holes, tearing, or stitching damage.

DETAILED DESCRIPTION

Figure 1B:
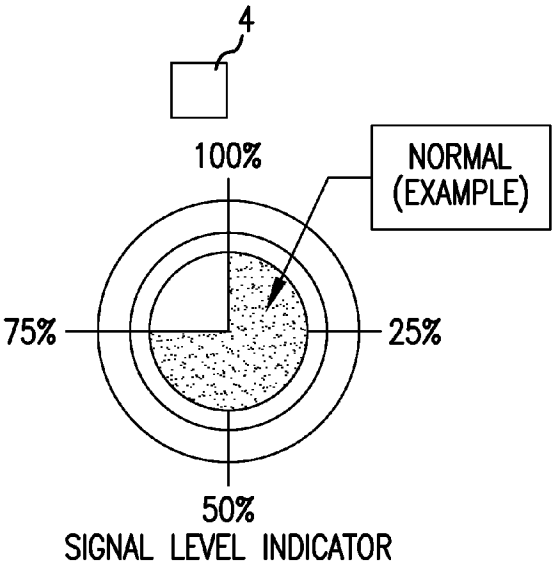
FIG. 1B illustrates aspects of signal detection of the harness of FIG. 1A.

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

In one aspect of the invention, webbing can communicate to a user when there is critical damage to a harness. This allows the user to know when the harness is not safe anymore for the application. An indicator can emit visual, audible indicia, or transmit a wireless communication to a safety officer, or manager. In another aspect of the invention, the webbing used for the harness can be made with a %' of 'conductive fibers' which can provide a signal when one or more fibers has been altered or damaged. The webbing can be manufactured with electrically conductive fibers, for example steel or copper fibers, and/or optical fibers incorporated into the material itself during the original manufacturing operation. In the case of electrically conductive fibers, a small electric current can flow through some or all of the harness, from shoulders and neck to the legs.

When an incident occurs that might damage the material, for example due to abrasion, degradation, corrosion, moisture, cuts & holes, tearing, stitching damages, impacts and the like the steel fibers integrated into the material will be affected, causing a variation of the conductivity of at least a portion of the harness. This variation can be sensed and used to provide a fault signal. This signal which can be used to activate a visual, an audible, or an electronic indicator of the existence of a fault.

In yet another aspect of the invention, a manually operable fault indicating device, a button or switch lever, can be carried on the harness. A user can manually actuate the device and automatically transmit a warning signal or notice to a displaced monitoring unit.

In other aspects of the invention, the sensitivity of a harness in accordance can be calibrated not only by the number of conductive fibers incorporated into various webbing elements, which may vary depending on the location of a given element, but also by the location of the fiber(s) in the woven material.

Integrated, programmable, control circuitry carried by the harness can evaluate the received signals, indicative of harness condition and activate one of a variety of alarms depending on the nature and extent of the detected damage. Different harnesses can be programmed to behave differently depending on the expected environment, use and size FIG. 1A illustrates a harness 10 which embodies the invention. Harness 10 is depicted as having substantial mirror symmetry about a median sagittal plane 16. Harness 10 includes a plurality of straps, or webbing 12, such as 12-1, -2, -3 . . . -n configurable, as would be understood by those of skill in the art so as to be wearable by a user. Harness 10 includes straps that form a criss-cross 18 in a dorsal region of a wearer's back when worn. Electrically or optically conductive strands, or fibers, such as 12*a*, 12*b* are woven into or otherwise embedded into webbing elements 12-*i*. The webbing sections such as 12-*i* function as forms of textile electrodes.

A source of electrical energy 14, which could be a replaceable battery, can be coupled via a connector 14-1 carried on webbing 12-2, to the strands 12*a*, 12*b*. The source 14 can couple electrical or optical signals along webbing 12-*i* to be detected by a sensor 20, also carried on webbing, such as 12-3. The sensor 20 could detect, for example a current flow in strands 12*a*, 12*b* or a received optical intensity. Determination circuitry 22, carried on webbing 12-3 and coupled to sensor 22 can respond to changes in output from the sensor 20 as the condition of the harness changes.

Circuitry 22 can be implemented at least in part with a programmable controller. The associated control program can be varied depending on the application and environment.

Harness 10 can also carry a manually operable device 26 actuatable by a user to transmit a warning message, such as message 30 to remote monitoring unit U indicating that the user has detected a fault.

Further various types of warning indictors can be generated by harness 10. Exemplary variations include but are not limited to, manually generated alarm messages, impact, or fall indicating alarms or messages, alarms that indicate one or more cuts have been detected on webbing material, tearing or abrasion of webbing material, or other variations or degrading conditions that might be detected as indicated by variations of the signal detected in the sensor 20, all without limitation.

Figure 1A:
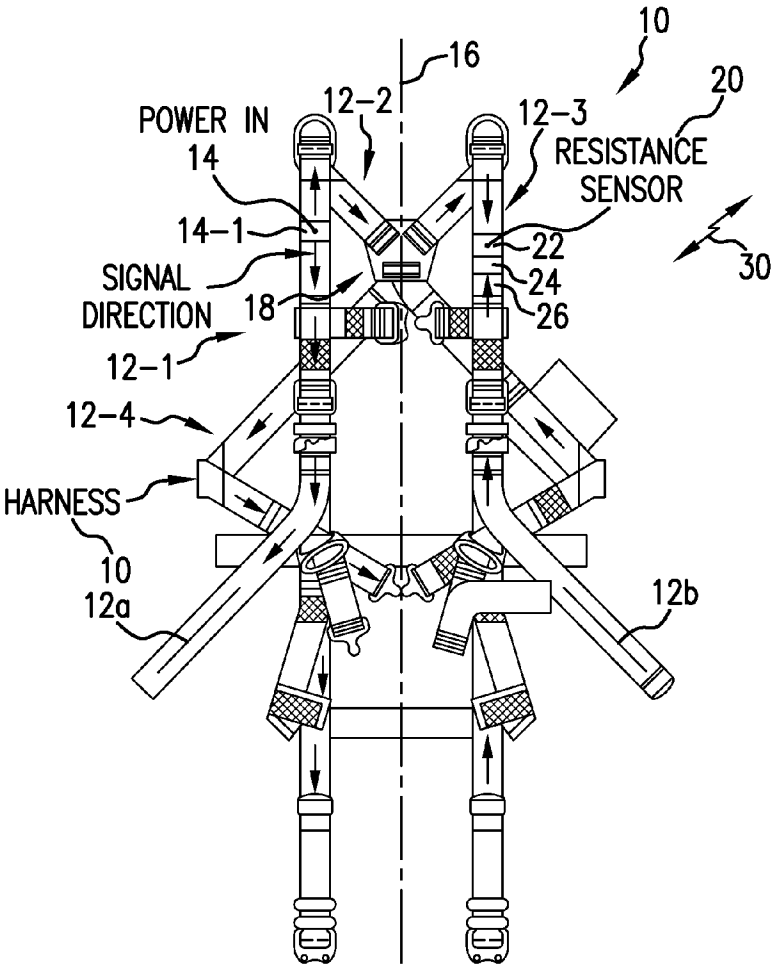
FIG. 1A is a front planar view of a harness that embodies the invention.

FIG. 1B illustrates expected or normal signal strength received at sensor 20 when harness 10 is in an acceptable, operational condition. The signal strength can be indicative, for example of electrical resistance between the source 14 and sensor 20, or other electrical parameters without limitation.

If one or more webbings, such as 12-*i* becomes damaged through use, then the sensed signal, at sensor 20 will change from that illustrated in FIG. 1B and be indicative of a degraded condition of harness 10. In this instance, the circuitry 22 can activate a warning device, such as audible or visual warning device 24 carried on harness 10. In addition, circuitry 22 can transmit a wireless signal 30 to a displaced monitoring unit U, indicative of a degraded, possible dangerous, condition in harness 10.

Figure 2B:
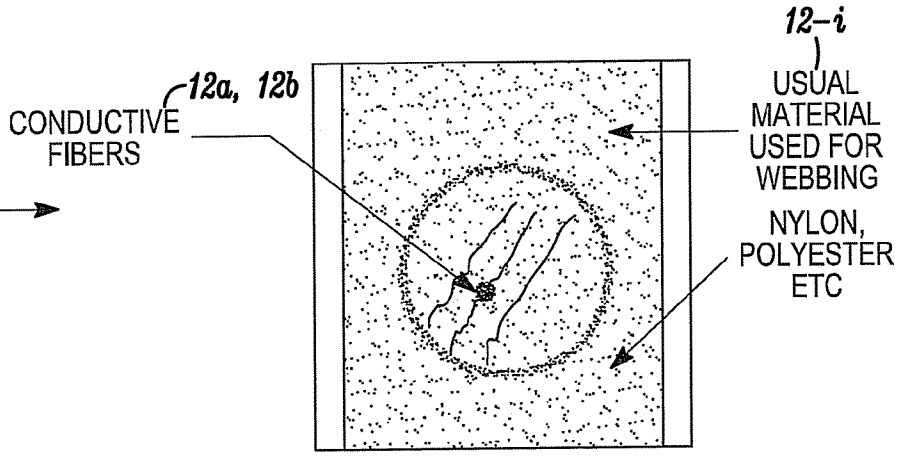
FIG. 2B is an enlarged partial view of a portion of the webbing of FIG. 2A.
Figure 2C:
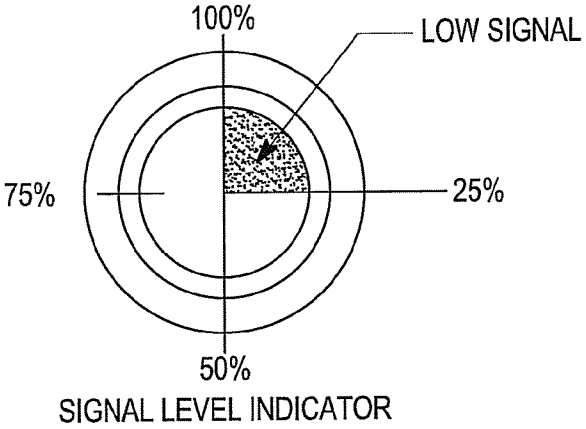
FIG. 2C illustrates additional aspects of signal detection of the harness of FIG. 1A.
Figure 2A:
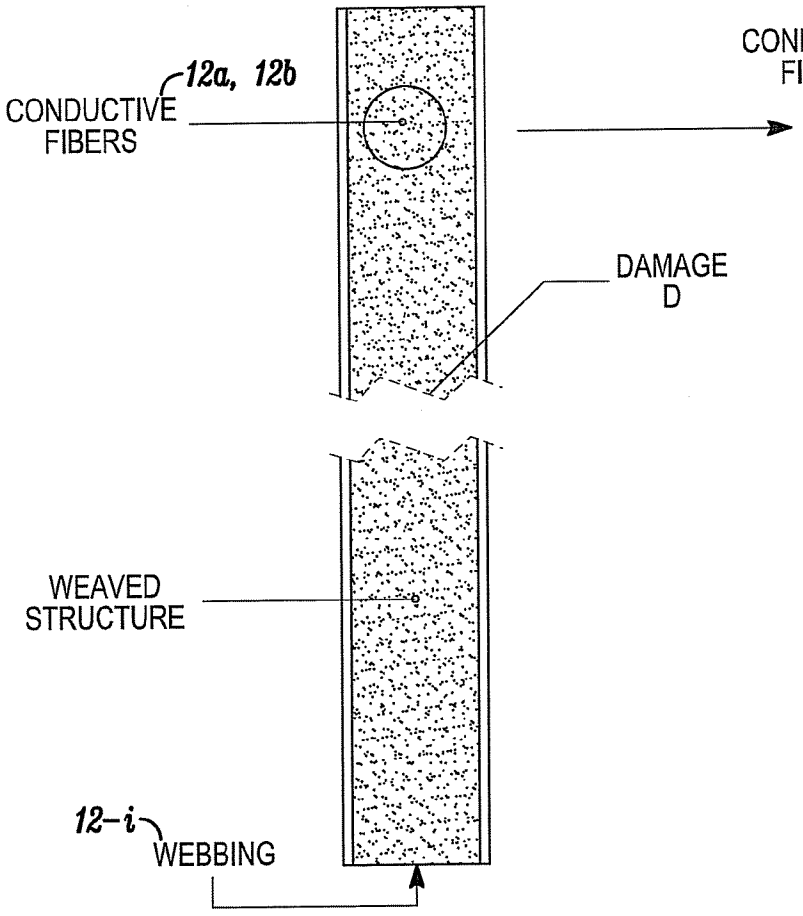
FIG. 2A is a planar view of an exemplary section of webbing that has been damaged.

FIGS. 2A-C illustrate additional aspects of the invention. Webbing 12-I, a woven structure, from the harness 10 is illustrated containing a plurality of woven conductive (electrical or optical) elements 12, *b*. In the presence of damage D, a portion of the conductors 12*a*, 12*b*, may be cut, damaged or degraded so that they do not conduct optical or electrical signals as normally indicated in FIG. 1B.

As a result of damage D, the sensor 20 will receive a signal of lower amplitude, less power, less intensity or the like. In such event, circuitry 22 can activate alarm device 24 to warn the user.

Figures 3A, 3B:
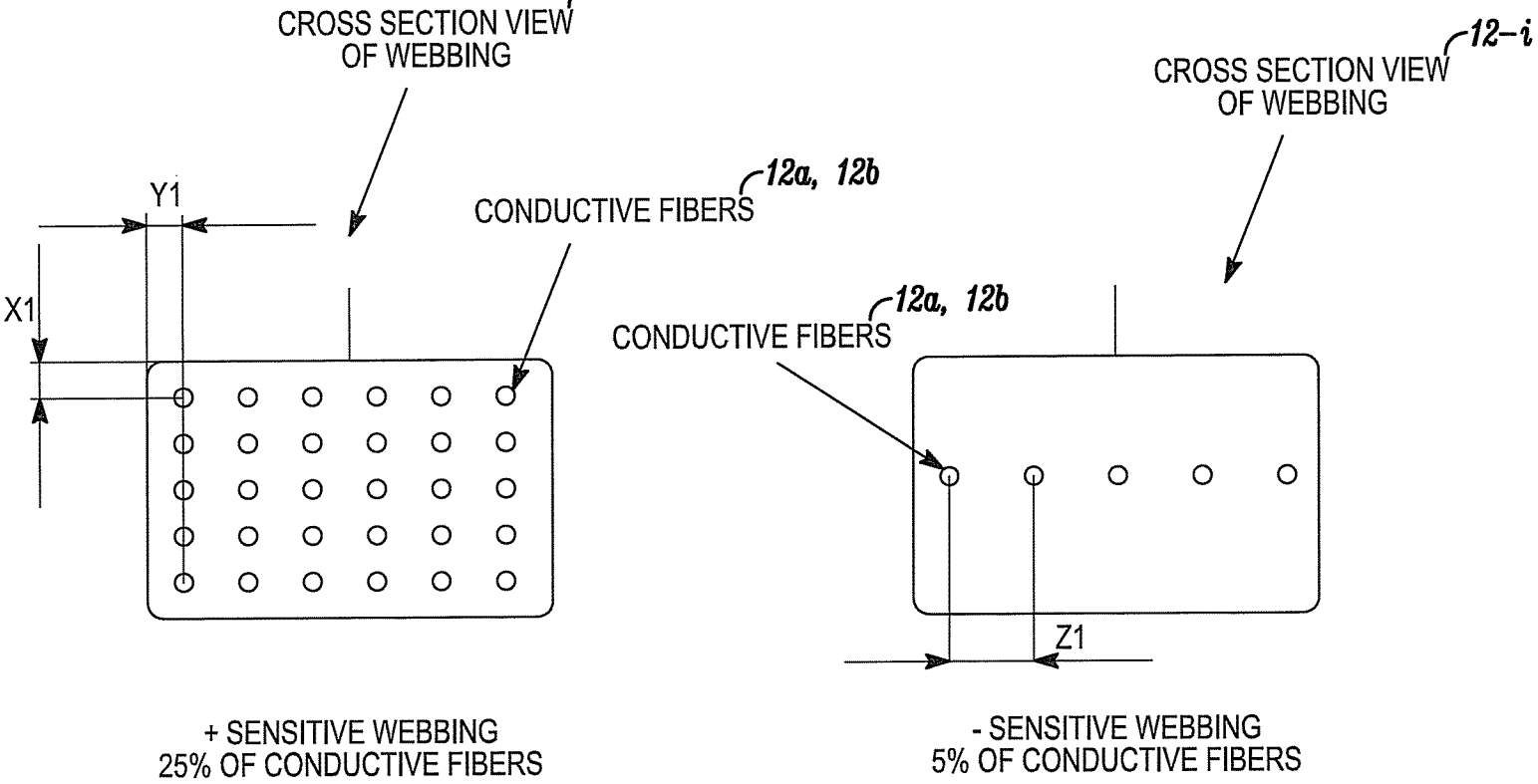
FIG. 3A illustrates a cross-section of a part of an exemplary web with a first density of conductive fibers.
FIG. 3B illustrates a cross-section of a part of an exemplary web with a second density of conductive fibers.

FIGS. 3A, 3B illustrate one form of webbing conductivity variation to alter sensitivity. In FIG. 3A a substantially higher percentage of conductive fibers 12*a*, 12*b* are woven into the webbing 12—producing in FIG. 3A a more sensitive webbing than in FIG. 3B.

Figure 4C:
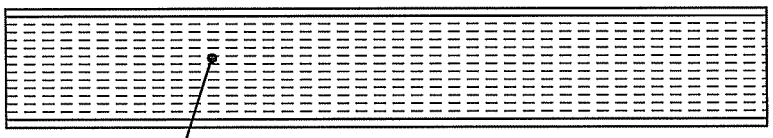
FIG. 4C is a planar view illustrating yet another form of a woven web.
Figure 4B:
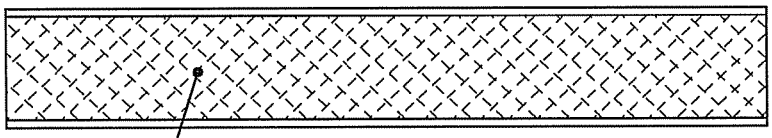
FIG. 4B is a planar view illustrating another form of a woven web.
Figure 4A:
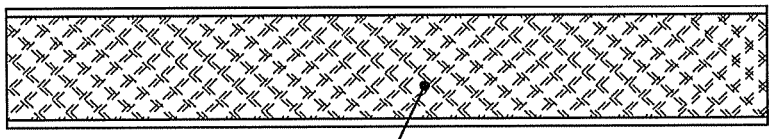
FIG. 4A is a planar view illustrating one form of a woven web.
Figure 5A:
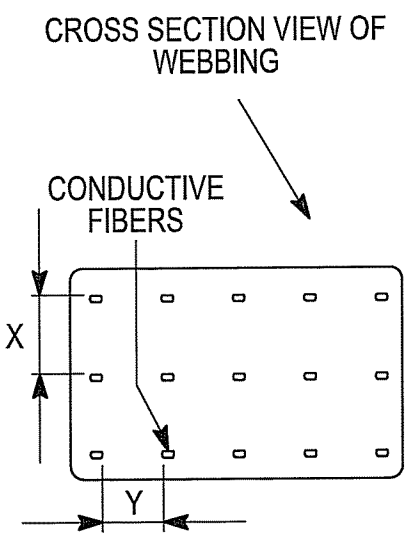
FIG. 5A illustrates all edges sensitive webbing.
Figure 5B:
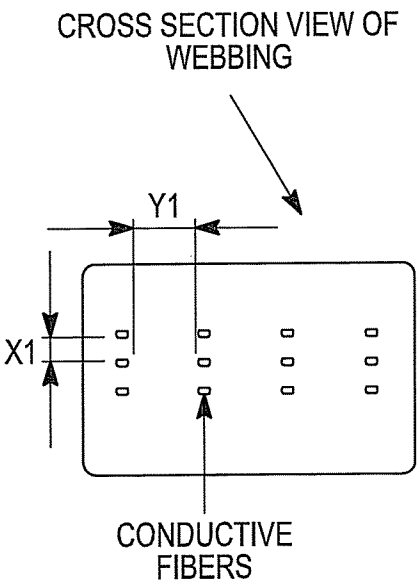
FIG. 5B illustrates center sensitive webbing.
Figure 5C:
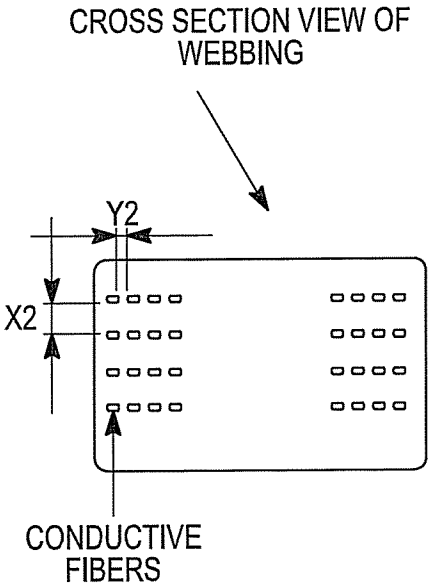
FIG. 5C illustrates some edges sensitive webbing.

FIGS. 4A, 4B and 4C illustrate different, exemplary, weavings which might be used to implement webbing, such as 12-I used in harness 10. FIGS. 5A, 5B and 5C illustrate webbings having conductive fibers located at different locations to adjust surfaces or regions which are sensitive to damage.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

We claim:

1. A fall protection safety harness comprising:

the fall protection safety harness having substantial mirror symmetry about a median sagittal plane and comprising woven webbing which includes a plurality of at least one of electrically conductive fibers, or, optically conductive fibers;

a signal sensor coupled to at least some of the fibers;

a condition indicating output device coupled to the sensor and carried by the harness; and an electrical contact for a source of energy to couple a signal to at least one of the fibers wherein the sensor will receive a signal when at least some of the fibers have been changed in condition in comparison to their original condition.

2. The fall protection safety harness as in claim 1 where the output device is responsive to a sensed variation of the signal.

3. The fall protection safety harness as in claim 1 where the signal sensor comprises one of an electrical sensor or an optical sensor.

4. The fall protection safety harness as in claim 1 where the output device is at least one of an audible output device or a visual output device.

5. The fall protection safety harness as in claim 1 where at least some of the conductive fibers are located on predetermined portions of the woven webbing.

6. The fall protection safety harness as in claim 5 where the output device is responsive to a sensed variation of the signal.

7. The fall protection safety harness as in claim 1, wherein the webbing includes straps that form a criss-cross in a dorsal region of a wearer's back when worn.

8. A fall protection safety apparatus comprising:

a human wearable fall protection harness having substantial mirror symmetry about a median sagittal plane and which includes a plurality of, at least in part, conductive webbings where the webbings form fabric conductors of one of electrical signals, or optical signals, and where the conductors are selected from a class which includes at least electrical conductors or optical conductors; and control circuits, carried by the harness, which are responsive to variations in signals received from the conductors to emit at least one fault indicating alarm.

9. The fall protection safety apparatus as in claim 8 which includes a condition indicating wireless transmitter coupled to the control circuits.

10. The fall protection safety apparatus as in claim 8 where the conductors exhibit a predetermined pattern relative to respective harness webbings.

11. The fall protection safety apparatus as in claim 8 which carries a manually operable alarm generating device, coupled to the control circuits.

12. The fall protection safety apparatus as in claim 11 which includes a condition indicating wireless transmitter coupled to the control circuits where the transmitter emits an alarm indication in response to operation of the alarm generating device.

13. The fall protection safety apparatus as in claim 12 further comprising a receptacle to receive a replaceable power supply.

14. The fall protection safety apparatus as in claim 8, wherein the webbings include a portion that forms a criss-cross in a dorsal region of a wearer's back when worn.

15. A fall protection safety apparatus comprising:

a human wearable fall protection harness having substantial mirror symmetry between a left leg loop webbing and a right leg loop webbing, wherein the left leg loop webbing and the right leg loop webbing each form fabric conductors of one of electrical signals or optical signals, and where the conductors are selected from a class which includes at least electrical conductors or optical conductors; and, a control circuit interface, carried by the harness, for communicating at least one of the electrical signals or the optical signals received from the conductors to a control circuit configured to emit at least one fault indicating alarm responsive to at least one predetermined variation in the signals.

16. The fall protection safety apparatus of claim 15, further comprising a control circuit that, when in operable communication with the control circuit interface, is operable to emit at least one fault indicating alarm in response to the at least one predetermined variation in the electrical signals or the optical signals.

17. The fall protection safety apparatus of claim 16, wherein the control circuit is carried by the harness.

18. The fall protection safety apparatus of claim 16, wherein the control circuit receives, via the control circuit interface, condition information about the harness, wherein the control circuit is disposed at a monitoring site displaced from the harness.

19. The fall protection safety apparatus of claim 15, wherein the control circuit interface includes a wireless transmitter for wirelessly communicating with a control circuit.

20. The fall protection safety apparatus of claim 15, further comprising a manually operable alarm generating device electrically coupled to the control circuit interface.

21. The fall protection safety apparatus of claim 20, further comprising a condition indicating wireless transmitter electrically coupled to the control circuit interface, wherein the transmitter emits an alarm indication in response to operation of the alarm generating device.

22. A fall protection safety apparatus comprising:

a human wearable fall protection harness having a webbing that forms a criss-cross in a dorsal region of a wearer's back when worn, wherein the webbing comprises fabric conductors of one of electrical signals or optical signals, and where the conductors are selected from a class which includes at least electrical conductors or optical conductors; and, a control circuit interface, carried by the harness, for communicating at least one of the electrical signals or the optical signals received from the conductors to a control circuit configured to emit at least one fault indicating alarm responsive to at least one predetermined variation in the signals.

23. The fall protection safety apparatus of claim 22, further comprising a control circuit that, when in operable communication with the control circuit interface, is operable to emit at least one fault indicating alarm in response to the at least one predetermined variation in the electrical signals or the optical signals.

24. The fall protection safety apparatus of claim 23, wherein the control circuit is carried by the harness.

25. The fall protection safety apparatus of claim 23, wherein the control circuit receives, via the control circuit interface, condition information about the harness, wherein the control circuit is disposed at a monitoring site displaced from the harness.

26. The fall protection safety apparatus of claim 22, wherein the control circuit interface includes a wireless transmitter for wirelessly communicating with a control circuit.

27. The fall protection safety apparatus of claim 22, further comprising a manually operable alarm generating device electrically coupled to the control circuit interface.

28. The fall protection safety apparatus of claim 27, further comprising a condition indicating wireless transmitter electrically coupled to the control circuit interface, wherein the transmitter emits an alarm indication in response to operation of the alarm generating device.

* * * * *